US006077072A

United States Patent [19]

Marin et al.

[11] Patent Number: 6,077,072

[45] Date of Patent: Jun. 20, 2000

[54] PREFFERENTIAL OXYGEN FIRING SYSTEM FOR COUNTER-CURRENT MINERAL CALCINING

[75] Inventors: Ovidiu Marin, Lisle; Mahendra L. Joshi, Darian; Olivier Charon, Chicago, all of Ill.; Jacques Dugue, Montigny le Bretonneux, France

[73] Assignees: American Air Liquide Inc., Walnut Cree, Calif.; L'Air Liquide, Societe Anonyme pour l'Etude et l'Exploitation des Procedes Georges Claude, Paris, France

[21] Appl. No.: 09/156,753

[22] Filed: Sep. 18, 1998

[51] Int. Cl.[7] ..... F27B 7/36

[52] U.S. Cl. ..... 432/105; 110/226; 431/10

[58] Field of Search ..... 432/72, 103, 105, 432/111, 117; 431/10, 159, 162, 165, 278, 285; 110/226, 246, 346, 347, 348

[56] References Cited

U.S. PATENT DOCUMENTS

| | | | |
|---|---|---|---|
| 3,397,256 | 8/1968 | Paul et al. . | |
| 3,488,700 | 1/1970 | Iken et al. | 432/111 |
| 3,809,525 | 5/1974 | Wang et al. | 431/182 |
| 4,354,829 | 10/1982 | Estes . | |
| 4,741,694 | 5/1988 | Mason et al. . | |
| 5,007,823 | 4/1991 | Mayotte et al. . | |
| 5,372,458 | 12/1994 | Flemmer et al. | 432/111 |
| 5,431,559 | 7/1995 | Taylor | 431/10 |
| 5,572,938 | 11/1996 | Leger . | |
| 5,580,237 | 12/1996 | Leger . | |
| 5,762,486 | 6/1998 | Leger | 431/10 |

OTHER PUBLICATIONS

Gaydas, R.A., "Oxygen Enrichment of Combustion Air in Rotary Kilns," Journal of the PCA R & D Laboratories, 49–66 (Sep. 1965).

Wrampe, P. and Rolseth, H.C., "The effect of oxygen upon the rotary kiln's production and fuel efficiency: theory and practice," IEEE Trans. Ind. App., 568–573 (Nov. 1976).

*Primary Examiner*—Teresa Walberg
*Assistant Examiner*—Gregory A. Wilson
*Attorney, Agent, or Firm*—Burns, Doane, Swecker & Mathis, LLP

[57] ABSTRACT

Superior heat transfer in a kiln is achieved by the use of at least one injector which injects both an oxidant, preferably containing oxygen, and a secondary fuel into the kiln. The injectors are provided so that the energy resulting from the combustion of the different fuels in the kiln heats specified regions of the kiln, without causing hot spots on the refractory walls. A firing scheme is described for the oxygen and fuels which allows an increase in the amount of heat released toward the load, resulting in significant increases in kiln efficiency and production. Low quality fuels may be used, as well as using and/or recycling more insufflated dust, without an adverse effect on the main flame.

23 Claims, 4 Drawing Sheets

PREFFERENTIAL OXYGEN FIRING SYSTEM FOR COUNTER-CURRENT MINERAL CALCINING

BACKGROUND OF THE INVENTION

1. Field of the Invention

The present invention relates to novel apparatus and processes for the injection of oxygen into a rotary kiln. More particularly, the present invention relates to apparatus and a processes which significantly improve combustion in a rotary kiln used for the calcination of minerals such as cement, lime, dolomite, magnesia, titanium dioxide, and other calcined materials 2. Brief Description of the Related Art The introduction of oxygen into a combustion space, e.g., a furnace, is used in a variety of industries for the enhancement of the combustion process. To date, the use of oxygen in rotary kilns has been applied in three main ways, well documented in literature: introducing oxygen into the primary air, i.e., into the main burner; the utilization of an oxy-burner in addition to a standard air burner; and oxygen lancing into the rotary kiln, particularly in a region between the load and the flame, for improved flame characteristics. One of the more documented uses of oxygen in rotary kilns is described in Wrampe, P. and Rolseth, H. C., "The effect of oxygen upon the rotary kiln's production and fuel efficiency: theory and practice", IEEE Trans. Ind. App., 568–573 (November 1976), which indicates that production increases above 50% produce excessive temperatures into the kiln, but, below this level, kiln operation takes place without major problems.

Each method of introducing oxygen into the calcining plant has its advantages, as well as certain disadvantages. Thus, the total amount of oxygen which can be introduced into the primary air is limited, since the primary air-type kilns constitute only a relatively small proportion (5–10%) of modern rotary kilns. Therefore, in order to significantly increase the amount of oxygen introduced into the kiln, a large concentration of oxygen into the air-fuel mixture is necessary. This leads to potential safety problems, since the fuel is in contact with significantly enriched air prior to its arrival into the combustion space, and therefore it can burn too early, or even cause explosions. The use of oxy-burners, while offering the potential of improved overall heat exchange to the load, can require using a large amount of high-quality, high-cost fuel within the oxy-burner for a significant impact on product, e.g., clinker, formation. At the same time, the impact of the oxy-flame on the main fuel combustion may be limited.

The introduction of oxygen into the primary air in a kiln drastically limits the amount of oxygen which can be introduced into the kiln, and also only uniformly improves combustion in the entire kiln volume. The advantages of using oxygen are therefore diminished by the overheating of the kiln walls which results from the uniform increase in heat transfer to the kiln volume, without preferentially transferring heat to the load. The same effect is obtained when oxygen lances are installed into the main burner.

The use of a separate oxy-burner represents a more involved method to increase the thermal transfer to the load, which typically requires increased quantities of quality fuel, such as natural gas. The use of lances, although potentially leading to improvements in the flame patterns, has only limited capabilities. Thus, when utilizing lances located in the main burner, the flame radiates in all directions with the same intensity, providing a large portion of the heat directly to the walls, thus overheating the kiln walls. The high grade heat provided by the oxy-flame is therefore poorly used, with accompanying losses in the kiln's efficiency. Placement of the lances between the burner and the flame has partially corrected this problem, but results in mixing the fuel and the oxygen further in the kiln, which leads to a longer, less radiant flame. Furthermore, the flame tends to touch the kiln walls in a region where it overheats the wall, without great thermal impact on the load.

The prior use of lances between the flame and the load therefore represents a relatively common method of enriching the combustion air. While this oxygen injection method can have a beneficial effect on the combustion process in the kiln, it has not had the capability of locally optimizing the heat transfer to the load, mainly because the fuel is fired in the same manner as in the absence of oxygen. This method also has a limited effect in situations where dust insulation is important, or when the fuel quality is very poor. Lances have been investigated by previous patents, including U.S. Pat. No. 5,572,938, U.S. Pat. No. 5,007,823, U.S. Pat. No. 5,580,237, and U.S. Pat. No. 4,741,694. Oxygen burner use in a dolomite kiln has been proposed by U.S. Pat. No. 3,397,256.

Finally, U.S. Pat. No. 4,354,829 describes mixing air and oxygen in a separate pipe, and introducing it through the moving walls of a rotary kiln. This approach has a number of problems, among which are the difficulty of creating a leak free plenum which rotates with the kiln, and the difficulty of installing tubes into the kiln. Indeed, introducing the air-oxygen mixture in the manner suggested by U.S. Pat. No. 4,354,829 results in unfavorable combustion characteristics, because the location at which the mixture is introduced may actually impede the combustion process. Additionally, the air introduced in the rotary kiln is cold, therefore introducing additional stresses in the rotary kiln which can damage its very expensive structure, etc.

The general use of oxygen in rotary kilns has already been shown to increase production, starting with the work of Gaydas, R. A., "Oxygen enrichment of combustion air in rotary kilns," Journal of the PCA R & D Laboratories, 49–66 (September 1965). This report presents test results from a period between 1960 and 1962. Gaydas mentions that Geissler suggested that oxygen be used for clinker production as early as 1903.

SUMMARY OF THE INVENTION

According to a first exemplary embodiment of the present invention, an apparatus useful for producing clinkers comprises a rotary kiln having a material inlet and a clinker outlet, a main burner positioned adjacent said clinker outlet for emitting a flame to heat the interior of said rotary kiln, an injector adjacent said main burner, said injector having a longitudinal axis and comprises an oxidant flow passage having and extending between an oxidant inlet and a secondary oxidant outlet, a primary oxidant flow passage having a primary oxidant outlet, at least one secondary fuel flow conduit having and extending between a secondary fuel inlet and at least one secondary fuel outlet, wherein said primary oxidant flow passage outlet is set at an angle a to said longitudinal axis ranging from about −20° to about 90°, wherein said at least one secondary fuel outlet and said secondary oxidant outlet are set at an angle β ranging from about 0° to about −90°.

According to a second exemplary embodiment of the present invention, a process for forming clinkers in a rotary kiln comprises the steps of moving material through a rotary kiln along a material path extending through said kiln to a material exit, heating said material with a main burner flame sufficiently near said material exit to transfer heat to the material, injecting primary oxidant into the main burner flame, and heating the material adjacent the material exit with a secondary flame directed substantially away from the main burner flame.

It is one object of the present invention to provide efficient apparatus and processes of introducing an oxidant, e.g. oxygen or oxygen-enriched air, into a kiln, e.g. a rotary kiln, in a manner which will enhance the flame characteristics and the heat transfer to the load.

It is another object of the present invention to provide an apparatus which provides a superior combustion process, as well as increased heat transfer to the load, with particular application to high temperature processes in which the final product has to be heated to about 2500° F. (1371° C.), and preferably above 3000° F. (1649° C.). Exemplary embodiments of the present invention are useful in counter-current mineral cacining apparatus and processes.

The present invention improves combustion in a kiln, preferably in a rotary kiln, by means of oxy-combustion. Oxygen is injected into the kiln, leading to increased heat transfer to the load without significantly overheating the kiln walls. The apparatus and processes of the present invention also lead to improved combustion in the main burner, allowing fuel savings and lowering emissions.

This invention provides improvements on the processes of injecting oxygen into a rotary kiln, and includes apparatus for this purpose. Processes and apparatus in accordance with the present invention preferentially provide oxygen into the kiln for a maximum effect, in terms of combustion and heat transfer to the load. Thus a certain amount of an oxidant, referred to herein as "primary oxygen," is injected towards the fuel originating from the main burner. The oxidant includes at least about 21% oxygen, preferably at least about 90% oxygen, and more preferably at least about 99% oxygen. The primary oxygen enhances the combustion process of this fuel, such that complete combustion is obtained, as well as a stable, luminous, and preferably relatively short flame. An additional flow-stream of oxygen, referred to herein as "secondary oxygen," and a secondary fuel are injected at a different angle into the kiln, in order to provide a short, very luminous flame designed to efficiently assist the clinkering process, prior to the clinker exit from the rotary kiln.

The role of secondary oxygen is very important for both proper clinker treatment and for optimal ignition and combustion of the primary fuel. The secondary oxy-flame provides an important amount of heat for the primary fuel, leading to rapid heating and ignition of the air-fuel-primary oxygen mixture, thus ensuring an effective, complete combustion process for the main fuel. This in turn allows the apparatus and processes of the present invention to process higher amounts of insufflated dust than prior kilns utilizing the same fuel flow rates, and decreases the amount of fuel needed to maintain the kiln heat transfer rates.

The present invention provides numerous additional advantages over prior kiln arrangements. The fuel used in the main burner of the present invention can be of inferior quality, with a higher content of ash or water, while retaining the desired levels of heat transfer. The combustion process is aided in at least two ways by the present invention: preheating the fuel, primary air, and secondary air for fast ignition; and providing oxygen to the main fuel for efficient combustion.

Furthermore, the rotary kiln can more efficiently recirculate dust that becomes entrained into the flue gases, because the increased thermal load to the main fuel provided by the combustion of the secondary oxygen-secondary fuel counteracts the inhibitory effects of dust insulation on the main fuel combustion. The primary oxygen flow, if not aided by the secondary oxygen-secondary fuel stream of the present invention, does not efficiently ensure that dust recirculation prior to fuel ignition will be achieved.

Additionally, the secondary oxygen and secondary fuel provide an efficient completion of the clinker formation process, increasing its temperature to the desired level at different positions along the clinkers' path through the kiln. Preferentially providing heat to the clinker load in the latest stage of the clinkering process, i.e., immediately prior to exiting from the kiln, significantly reduces the overall thermal load to the rotary kiln, with substantial fuel reduction and production increase.

The present invention also limits overheating of the kiln walls. The preferential heat released by the combustion process of the secondary fuel and secondary oxygen is particularly designed to locally heat the kiln load, as well as the main fuel, in a region situated in the vicinity of the main burner. The jet of the fuel-primary air-primary oxygen mixture protects the upper region of the kiln, i.e., the portion of the kiln wall on a side of the primary flame opposite the kiln load, from the higher thermal levels originated in the oxy-flame of the secondary fuel-oxygen combustion. This secondary combustion process releases most of its heat towards the load, preventing the formation of hot spots on the kiln refractory, which in turn results in improved fuel efficiency, lower fuel costs, and improved refractory service life. Increases in kiln production rates of up to 25% can be achieved.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
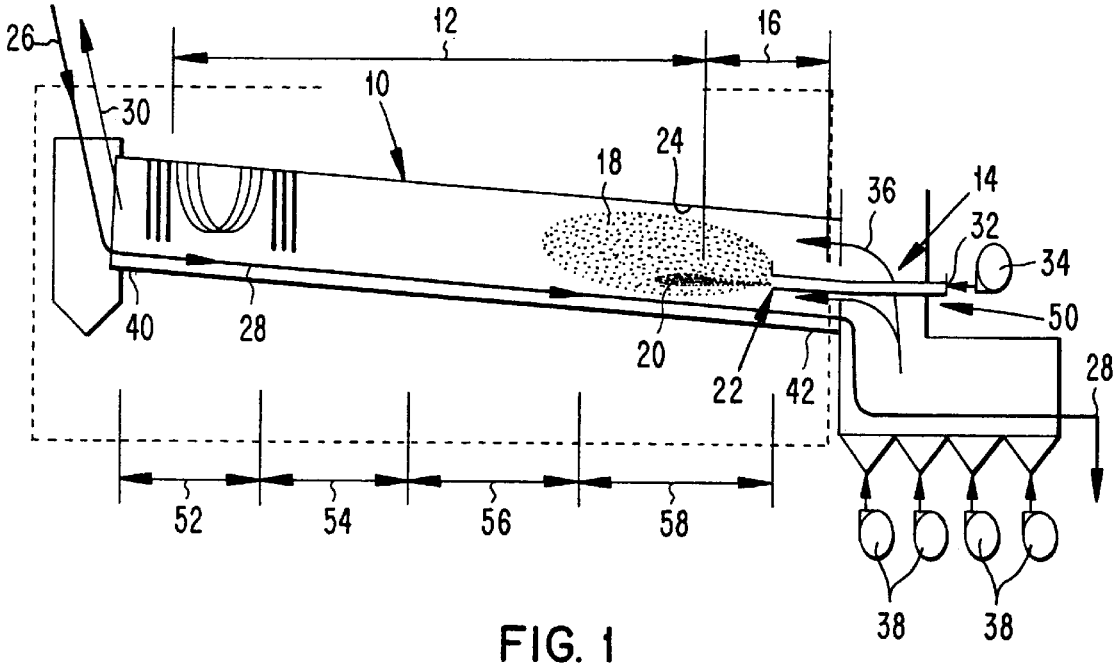
FIG. 1 is a schematic illustration of an exemplary rotary kiln in accordance with the present invention.

Referring to the drawing figures, like reference numerals designate identical or corresponding elements throughout the several figures.

FIG. 1 schematically illustrates a heating process resulting from the application of the present invention to a rotary kiln 10. The heat released into the kiln is divided into two main stages, termed with respect to their temporal impact on the clinker. Oxidant which is injected into the kiln in accordance with exemplary embodiments of the present invention includes at least about 21% oxygen, preferably at least about 90% oxygen, and more preferably at least about 99% oxygen. The first stage 12 is provided by the combustion of the fuel-air-primary oxygen mixture 18, originating from the main burner 14 and the primary oxygen injection jet 20 of this invention. The second stage 16 is provided by the combustion of the secondary fuel-secondary oxygen jets 22, and is designed to efficiently complete the clinkering process, prior to the finite product exit from the kiln. A portion of the heat provided by this secondary combustion process is also used by the main burner for heating and igniting purposes. The heat resulting from the secondary fuel-secondary oxygen combustion plays a significant role in preheating the reactants flowing out of main burner 14. As suggested by FIG. 1, the main fuel-primary air jet 18 has an insulating role for the rotary kiln refractory walls 24, absorbing an important amount of heat released from the secondary fuel-secondary oxygen combustion process.

Also illustrated in FIG. 1, kiln 10 is supplied with raw material 26 for the clinkering process which proceeds along a material flow path 28 through the kiln. Primary air 32 is introduced into the kiln through burner 14, optionally forced by a primary air blower 34. Secondary air 36 flows into kiln 10, optionally forced by secondary air blowers 38. Flue gas 30 produced by the burners flows out of the rotary kiln 10 at the upper end 40, while hot clinkers exit the kiln along flow path 28 at the lower end 42 of the kiln.

A secondary injector 50 in accordance with the present invention is positioned at lower end 42 of kiln 10, and supplies secondary fuel, secondary oxygen, and primary oxygen to the kiln. Secondary fuel-secondary oxygen jets 22 and primary oxygen jet 20 exit injector 50, as will be more fully described below. As illustrated in FIG. 1, secondary fuel-secondary oxygen jets 22 are directed toward flow path 28, and therefore at the preheated clinkers (not illustrated in FIG. 1) passing therealong. The heat transfer from the combination of main burner 14 and injector 50 produce a series of effects on the material which passes along flow path 28, the effects roughly catagorized by the following zones of kiln 10: a drying zone 52, wherein water and other volatile substances are driven off of the raw material; a preheating zone 54, wherein the temperature of the dry, raw material from drying zone 52 is raised to a predetermined temperature; a calcining zone 56; and a burning zone 58, wherein the final clinker formation process is performed prior to exiting the kiln.

Figure 2:
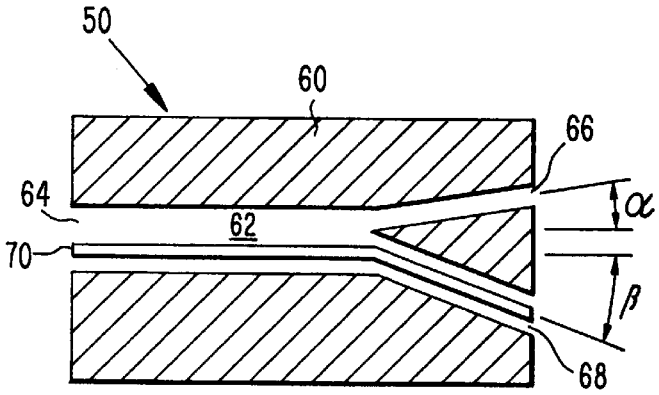
FIG. 2 schematically illustrates portions of an exemplary embodiment of a secondary burner in accordance with the present invention.

FIG. 2 schematically illustrates a first exemplary embodiment of an injector 50 in accordance with the present invention. The orientation of injector 50 is reversed in FIG. 2 relative to its orientation in FIG. 1. Injector 50 includes a body 60 having several flow passages formed therein for directing the flow of the several gas jets therethrough. Body 60 includes an oxygen passage 62 having an inlet 64, a primary oxygen outlet 66, and a secondary oxygen outlet 68. A secondary fuel flow passage 70, e.g., a lance, extends through body 60 and terminates at secondary oxygen outlet 68.

Primary oxygen outlet 66, and secondary oxygen outlet 68 and secondary fuel flow passage 70, are preferably angled with respect to a longitudinal axis of body 60 to direct the jets of oxygen and oxygen-and-fuel toward the main burner flame and preheated clinkers, respectively. Thus, the primary oxygen flows out of injector 50 at an angle a from the longitudinal axis of body 60, the direction of the flow ensuring a maximum impact on the combustion process of the primary fuel injected through the main burner. The secondary oxygen and the secondary fuel exit the device at an angle β, selected such that the heat released by their combustion serves the desired goals, namely providing heat to the load, to the main fuel, or both. The mass flow ratio of the primary-to-secondary oxygen, as well as the different flow rates through the body 60, are easily tailored based on the particular application for which the kiln is used, and for maximum efficiency at the lowest possible flow rates, as will be readily apparent to one of ordinary skill in the art.

Injector 50 serves at least two distinct and complementary functions. According to a first preferred use of injector 50, relatively low oxygen mass flow rates through secondary oxygen outlet 68 (with an accompanying stoichiometric amount of secondary fuel) enables the secondary flame 22 (see FIG. 1) to act as a pilot for main flame 18, which thereby stabilizes the main flame. Therefore, higher dust recycling (insufflation) can be accommodated by main flame 18 than without the presence of the primary oxygen, which leads to higher kiln production. The balance of the oxygen flowing through oxygen flow passage 62 therefore flows out primary oxygen outlet 66, which aids in complete combustion of the primary fuel. According to this first exemplary function, the relative amount of oxygen flowing out secondary oxygen outlet 68 is between about 1% and about 50% of the total oxygen flow, preferably between about 10% and about 20%.

According to a second preferred use of injector 50, secondary oxy-fuel flame 22 provides a significant amount of heat transfer to both the material in kiln 10 and the main flame 18, to heat the material to a final desired level above a temperature achieved by the main flame. In accordance with this second function, secondary oxygen is between about 50% and about 99% of the oxygen flowing through oxygen flow passage 62, preferably between about 80% and about 90%. When used in accordance with this second function, extremely high product, e.g., clinker, temperatures can be achieved with lower overall fuel consumption than with prior kilns, because the extremely high temperatures needed for clinker production are limited to a small space in the kiln volume. Additionally, this space is effectively insulated by main flame 18 from overheating the refractory on the side of the main flame opposite the direction of secondary oxy-fuel flame 22, which both extends the refractory service life and concentrates the heat transfer to the clinkers. Furthermore, the intense heat achieved in the small area by secondary oxy-fuel flame 22 further aids in stabilizing main flame 18, by heating the primary oxygen, primary air, and primary fuel as it exits main burner 14. Additionally, the extremely hot clinkers which are produced by the present invention are cooled in part by the secondary air 36, which is therefore preheated by the clinkers, which again aids in complete combustion and lowering of overall $No_x$ emissions.

Figure 3:
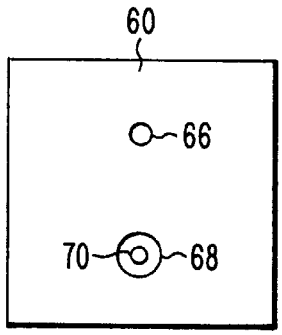
FIG. 3 is an end view of the burner illustrated in FIG. 2.

In accordance with the present invention, α is between about −20° and about 90° (negative indicating an angle below the horizontal or longitudinal axis), preferably between about −10° and about 50°, and more preferably between about −10° and about +10°. β is between about 0° and about −90°, preferably between about −3° and about −75°, and most preferably between about −3° and about −60°. Although schematically illustrated in FIGS. 2 and 3, body 60 may be constructed in any manner consistent with the usage thereof in a kiln. For example, body 60 may be formed from coaxial pipes, cast high temperature refractory material, machined, liquid-jacketed metals, or any other suitable material as will be readily apparent to one of ordinary skill in the art.

Figure 4:
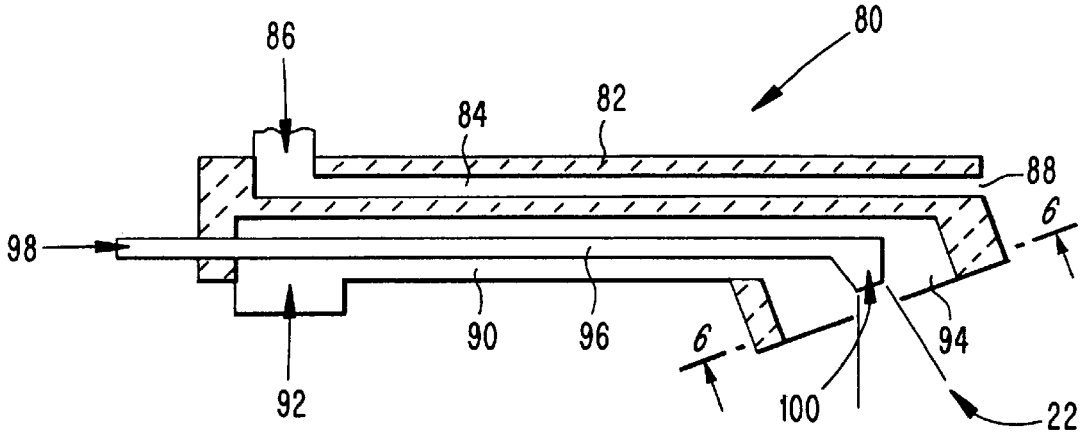
FIG. 4 schematically illustrates an exemplary embodiment of a secondary burner in accordance with the present invention.

FIG. 4 schematically illustrates another exemplary embodiment of an injector in accordance with the present invention. As illustrated in FIG. 4, an injector 80 includes a body 82 having defined therein several fluid flow passages. Different from injector 50, described above, injector 80 provides separate flow passages for the primary oxygen and secondary oxygen. The separate passages are provided to enable easier control over the flow rates of oxygen flowing therethrough, as will be readily appreciated by one of ordinary skill in the art. Specifically, body 82 includes a primary oxygen flow passage 84 having an inlet 86 and an outlet 88. Although illustrated, for simplicity, with primary oxygen outlet having an angle α=0, α can be selected to be any angle, as described above, to suit the particular kiln geometry and kiln usage.

Figure 5:
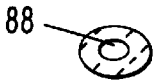
FIG. 5 is an end view of portions of the burner illustrated in FIG. 4.

Body 82 further includes a separate, secondary oxygen flow passage 90 having an inlet 92 and an outlet 94. A secondary fuel flow passage 96 having an inlet 98 and an outlet 100 extends through body 82. As illustrated in FIG. 4, secondary fuel flow passage 96 extends through secondary oxygen flow passage 90, but is sealed therefrom, and is preferably substantially coaxial therewith. Alternatively, secondary fuel flow passage 96 can extend through body 82 and join with secondary oxygen flow passage 90 only adjacent to outlet 100. Alternatively, passage 90 can be used to conduct fuel and passage 96 can be used to conduct oxygen. Secondary fuel from passage 96 and oxygen from passage 90 exit body 82 and form secondary flame 22. FIG. 5 illustrates an end view of primary oxygen outlet 88, while FIG. 6 illustrates an end view of secondary oxygen outlet 94 and secondary fuel outlet 100, taken at line 6—6 in FIG. 4.

Figure 6:
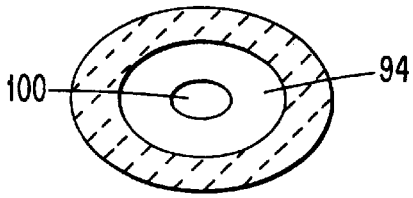
FIG. 6 is another end view of portions of the burner illustrated in FIG. 4.
Figure 7:
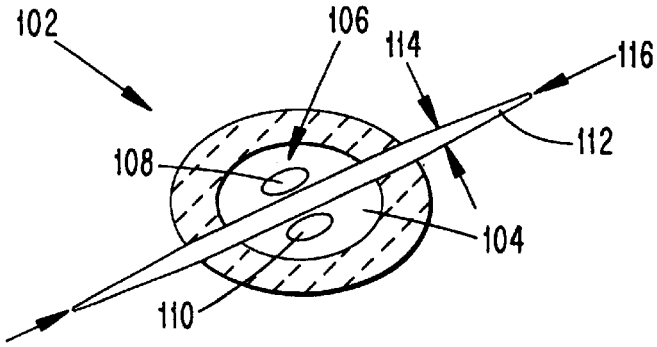
FIG. 7 illustrates an end view of an alternate embodiment of the burner illustrated in FIG. 4.

FIG. 7 illustrates an end view, similar to that illustrated in FIG. 6, of an injector 102, somewhat similar to injector 80. Injector 102 includes a primary oxygen flow passage (not illustrated) substantially similar to primary oxygen flow passage 84. Injector 102 includes a secondary oxygen passage 104 substantially similar to secondary oxygen passage 90, and a secondary fuel passage 106 having a pair of diametrically opposed outlets 108, 110. Secondary fuel passage 106 is substantially similar to secondary fuel passage 96, except for the two diametrically opposed outlets 108, 110. When fuel flows out outlets 108, 110 and combines with oxygen from secondary oxygen passage 104, a highly luminous, flat secondary flame 112 is formed by the convergent and jets of fuel exiting outlets 108, 110. Flat flame 112 can also be described as being fan-shaped, inasmuch as it fans out from the point of convergence of the fuel jets from outlets 108, 110. While secondary flame 22 is generally conical or frustoconical in shape, flat flame 112 is relatively small along a first direction 114, yet relatively large along a second direction 116. The long direction 116 of flat secondary flame 112 is preferably oriented in part along the long axis of kiln 10 by orienting outlets 108, 110, as will be readily appreciated by one of ordinary skill in the art. Thus, with flat flame 112 oriented along the length of kiln 10, relatively intense heating will be achieved by portions of the flat flame which impinge on clinkers very close to outlets 108, 110, which heating continuously diminishes for clinkers farther back in the kiln. Flat secondary flame 112 therefore contributes continuous and gradually increasing heat transfer to clinkers moving along flow path 28 (see FIG. 1), while reducing heat transfer to the kiln's refractory walls.

Figure 8:
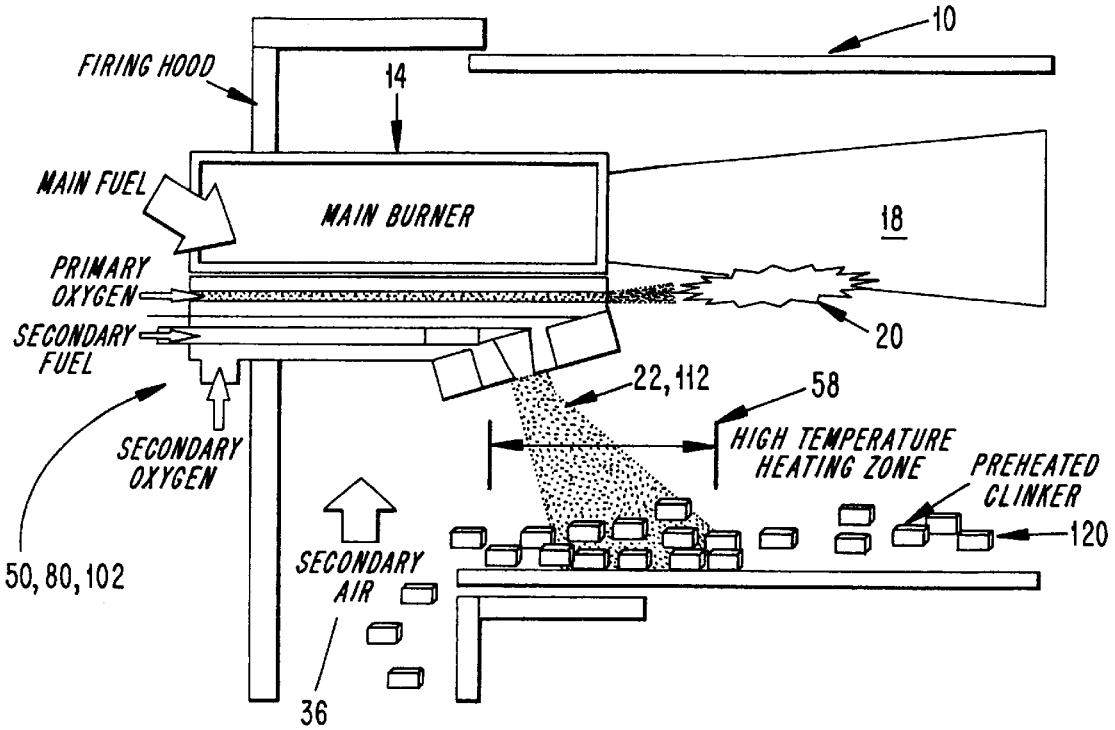
FIG. 8 schematically illustrates a rotary kiln incorporating the burners illustrated in FIGS. 2–7.

FIG. 8 illustrates the operation and function of a kiln 10 incorporating the injectors 50, 80, or 102 therein, to heat clinkers 120. Injector 50, 80, or 102 is preferably located in a region between the secondary air inlet and main burner 14, in order to provide oxygen into the main fuel jet at a convenient location to optimize the heat profile to the load and the characteristics of the flame, e.g., length, luminosity, etc. The angle β (see FIG. 2) is selected such that the effect of secondary flame 22, 112 provided by the secondary oxygen-secondary fuel be maximum, i.e., increased heat transfer to the load, increased heat transfer to the main flame, or both. As discussed above, the position of injector 50, 80, or 102 also preheats the secondary air prior to its mixing with the main fuel. The present invention provides intense heating caused by the secondary fuel-secondary oxygen, oriented towards the load just before the clinker exit towards the cooler (not illustrated). At the same time, the primary oxygen aids the combustion process of the main fuel, by providing the oxygen at an optimum location within the combustion space.

Figure 9:
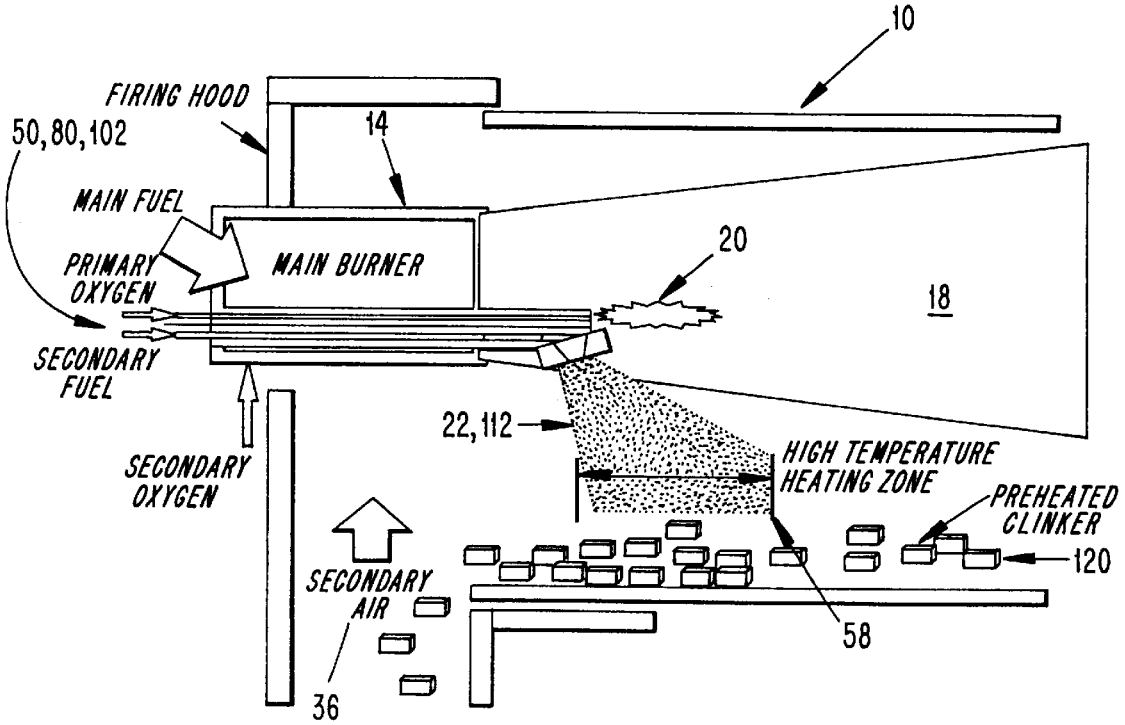
FIG. 9 schematically illustrates another embodiment of a rotary kiln incorporating the burners illustrated in FIGS. 2–7.

FIG. 9 illustrates an alternate embodiment of a kiln 10 incorporating injector 50, 80, or 102. In the embodiment illustrated in FIG. 9, injector 50, 80, or 102 is located within the main burner, and is preferably used in rotary kilns using fuel with reduced quality, for which significant amounts of heat are required for ignition and a good flame, relative to kilns burning higher quality fuels such as natural gas. By locating injector 50, 80, or 102 in the main burner, secondary flame 22, 112, which originates in the secondary fuel-secondary fuel combustion to more intensely heat the primary fuel-air mixture, leads to faster ignition of the primary fuel because of its closer proximity, and overlapping and intersecting jet paths. The embodiment illustrated in FIG. 9 is preferable in applications with intense dust insufflation, because secondary flame 22, 112 counteracts the inhibitory effects of the dust on the stability of main flame 18. The embodiment illustrated in FIG. 9 is also preferable for use with kilns using low quality fuel (e.g., recycled tires), for which the ignition process requires significant heat input.

Figure 10:
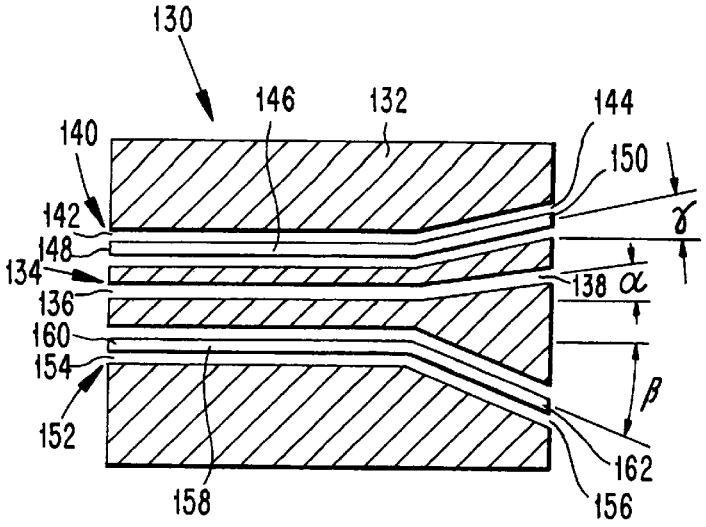
FIG. 10 schematically illustrates portions of another exemplary embodiment of a secondary burner in accordance with the present invention.
Figure 11:
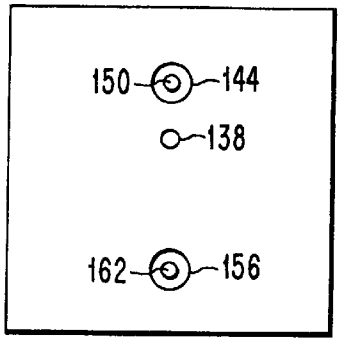
FIG. 11 is an end view of the burner illustrated in FIG. 10.

FIGS. 10 and 11 schematically illustrate yet another embodiment in accordance with the present invention. An injector 130, illustrated in cross-section in FIG. 10, is somewhat similar to injector 50 illustrated in FIGS. 2 and 3. Injector 130 can be used in a manner similar to those of injectors 50, 80, and 102. Injector 130 includes several fluid flow passages through body 132. A primary oxygen flow passage 134 includes an oxygen inlet 136 and an oxygen outlet 138. Oxygen outlet 138 exits body 132 at an angle a which is selected to be within the same ranges described above with respect to angle α in FIG. 2.

An upper, secondary oxygen flow passage 140 extends through body 132 from an upper secondary oxygen inlet 142 to an upper secondary oxygen outlet 144. An upper, secondary fuel flow conduit or lance 146 extends through upper secondary oxygen flow passage 140, and includes an inlet 148 and an outlet 150. Upper secondary oxygen outlet 144 and upper secondary fuel outlet 150 exit body 132 at an angle γ which is between about 0° and about 90°, preferably between about 3° and about 45°, and most preferably between about 3° and about 25°, from a longitudinal or horizontal axis of body 132.

A lower, secondary oxygen flow passage 152 extends through body 132 from a lower secondary oxygen inlet 154 to a lower secondary oxygen outlet 156. A lower, secondary fuel flow conduit or lance 158 extends through lower secondary oxygen flow passage 152, and includes an inlet 160 and an outlet 162. Lower secondary oxygen outlet 156 and lower secondary fuel outlet 162 exit body 132 at an angle β selected to be within the same ranges described above with respect to angle β in FIG. 2.

Injector 130 is constructed for and preferably used in applications in which extreme conditions exist, e.g., where high heat transfer rates are required to both the main burner and the clinker load. Injector 130 provides two separate jets of secondary fuel-secondary oxygen, a lower jet firing at an angle β below the horizontal, as described above with reference to injector 50 in FIG. 2, for an increased heat transfer to the clinker load. The upper jet fires at an angle γ towards main flame 18, in order to provide an increased heat transfer rate to the primary fuel-air jet. According to yet another embodiment (not illustrated), upper and/or lower secondary fuel conduits or lances 146, 158 can be formed with dual outlets, similar to outlets 108, 110 described above with reference to FIG. 7, to produce a flat secondary flame, for the reasons and benefits described above.

The embodiment illustrated in FIGS. 10 and 11 is preferably used in applications which have very adverse combustion conditions for the main fuel, such as large quantities of dust insufflated into the kiln, which can have a very significant quenching effect on the flame. The embodiment illustrated in FIGS. 10 and 11 allows better control the several flow rates of oxygen and fuel, thus permitting a more refined optimization of the oxygen and fuel consumption, leading to an improved efficiency of the entire process. Additionally, because the stability of main flame 18 is enhanced by the provision of upper secondary oxygen and fuel flow, the efficiency of a kiln incorporating injector 130 can be greatly enhanced.

Figure 12:
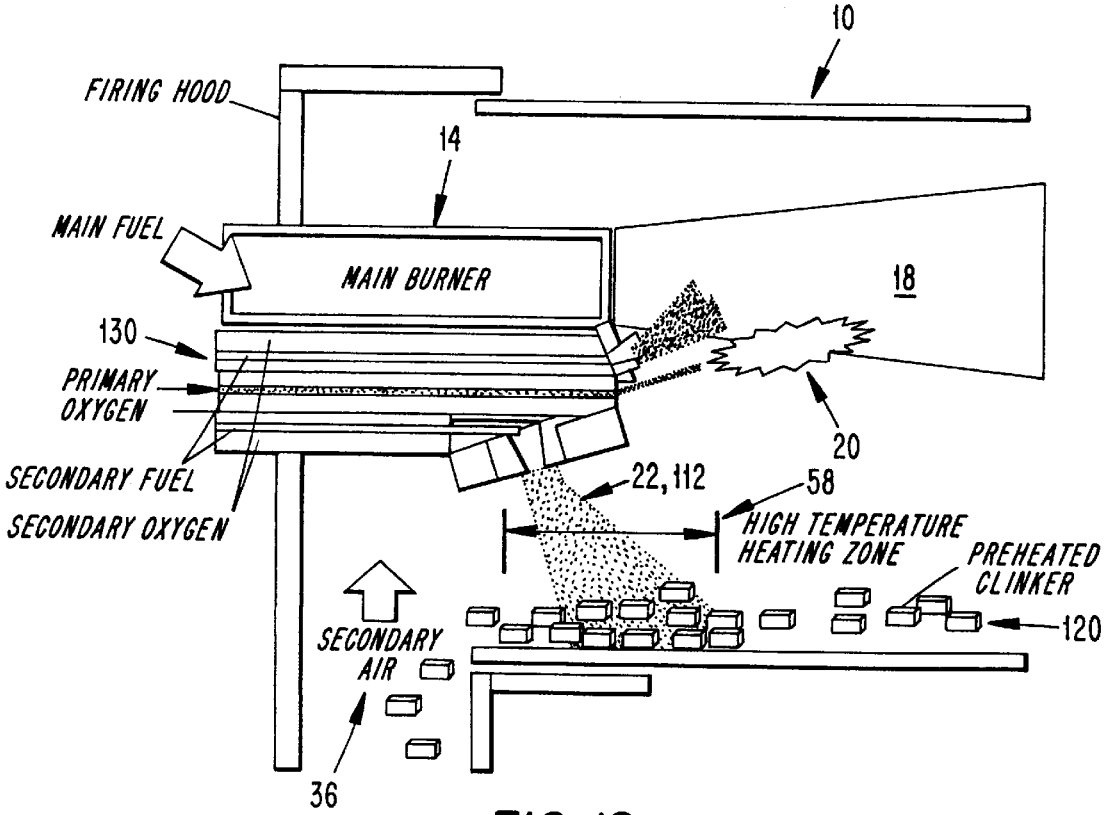
FIG. 12 schematically illustrates a rotary kiln incorporating the burner illustrated in FIGS. 10 and 11.

FIG. 12 schematically illustrates a kiln 10, incorporating injector 130 therein, an a manner similar to FIG. 8. The effect of the additional secondary fuel-secondary oxygen flame on the main fuel-air jet is clearly illustrated, which leads to the rapid ignition of the primary fuel, even in very adverse conditions. The ratio of the two secondary oxygen-secondary fuel flow rates is preferably selected to maximize the output of the kiln; thus, for applications requiring a large amount of dust insufflation or low fuel quality, a larger proportion of the secondary oxygen and fuel is directed to upper secondary flame is allotted. Alternately, for applications requiring larger temperatures in and heat transfer to the load, the lower secondary flame is allotted a greater proportion of the oxygen and fuel.

Generally, oxygen flow rates usable with the injectors of the present invention can vary over very wide ranges, and are selected based upon the particular kiln geometry and operating conditions. Preferably, oxygen flow rates for both the primary and secondary oxygen flow passages are between about 5000 scfh (standard cubic feet per hour) (135.1 $Nm^3$/hr) and about 150,000 scfh (4054 $Nm^3$/hr), with stoichiometric rates of secondary fuel accompanying the secondary oxygen flow.

While the invention has been described in detail with reference to preferred embodiments thereof, it will be apparent to one skilled in the art that various changes can be made, and equivalents employed, without departing from the scope of the invention. All of the aforementioned prior documents, including U.S. patents, are hereby incorporated in their entireties herein.

What is claimed is:

1. An apparatus useful for producing clinkers, comprising:

a rotary kiln having a material inlet and a clinker outlet;

a main burner for emitting a flame and positioned sufficiently near said clinker outlet to heat a load in the interior of said rotary kiln;

an injector adjacent said main burner, said injector having a longitudinal axis and comprising:

an oxidant flow passage having and extending between an oxidant inlet and a secondary oxidant outlet;

a primary oxidant flow passage having a primary oxidant outlet;

at least one secondary fuel flow conduit having and extending between a secondary fuel inlet and at least one secondary fuel outlet;

wherein said primary oxidant flow passage outlet is set at an angle α to said longitudinal axis ranging from about −20° to about 90°; and wherein said at least one secondary fuel outlet and said secondary oxidant outlet are set at an angle β ranging from about 0° to about −90°.

2. An apparatus in accordance with claim 1, wherein said angle α is between about −10° and about 50°.

3. An apparatus in accordance with claim 2, wherein said angle α is between about −10° and about 10°.

4. An apparatus in accordance with claim 1, wherein said angle β is between about −3° and about −75°.

5. An apparatus in accordance with claim 4, wherein said angle β is between about −3° and about −60°.

6. An apparatus in accordance with claim 1, wherein said primary oxidant flow passage is in fluid communication with said oxidant flow passage.

7. An apparatus in accordance with claim 1, wherein said at least one secondary fuel outlet comprises two secondary fuel outlets which are partially directed toward each other, wherein when secondary fuel flows out said two secondary fuel outlets and oxidant flows out said secondary oxidant outlet, a relatively flat flame is produced.

8. An apparatus in accordance with claim 7, wherein said two secondary fuel outlets are arranged and directed such that said relatively flat flame comprises a long cross-sectional dimension and a short cross sectional dimension, said long and short cross-sectional dimensions oriented in said kiln such that said relatively flat flame is directed in part down a length of said kiln.

9. An apparatus in accordance with claim 1, wherein said injector is located in said main burner.

10. An apparatus in accordance with claim 1, wherein said oxidant flow passage is a lower secondary oxidant flow passage, and further comprising:

an upper secondary oxidant flow passage having and extending between an upper secondary oxidant inlet and an upper secondary oxidant outlet;

said at least one secondary fuel flow conduit comprising an upper secondary fuel flow conduit having and extending between an upper secondary fuel inlet and an upper secondary fuel outlet, and a lower secondary fuel flow conduit having and extending between a lower secondary fuel inlet and a lower secondary fuel outlet.

11. An apparatus in accordance with claim 10, wherein said upper secondary oxidant outlet and said upper secondary fuel outlet are set at an angle γ between about 0° and about 90° to said longitudinal axis.

12. An apparatus in accordance with claim 11, wherein said angle γ is between about 3° and about 45°.

13. An apparatus in accordance with claim 12, wherein said angle γ is between about 3° and about 25°.

14. An apparatus in accordance with claim 10, wherein said upper secondary fuel conduit is inside said upper secondary oxidant flow passage, and said lower secondary fuel conduit is inside said lower secondary oxidant flow passage.

15. A process for forming clinkers in a rotary kiln, comprising the steps:

moving material through a rotary kiln along a material path extending through said kiln to a material exit;

heating said material with a main burner flame sufficiently near said material exit to transfer heat to said material;

injecting primary oxidant into said main burner flame; and heating said material adjacent said material exit with a secondary flame directed substantially away from said main burner flame.

16. A process for forming clinkers in a rotary kiln in accordance with claim 15, wherein said secondary flame is a lower secondary flame, and further comprising directing an upper secondary flame toward said main burner flame.

17. A process for forming clinkers in a rotary kiln in accordance with claim 15, wherein said secondary flame is a flat flame, and said step of heating said material comprises heating said material with said flat flame gradually along said material path.

18. A process for forming clinkers in a rotary kiln in accordance with claim 15, wherein said step of injecting primary oxidant into said main burner flame comprises injecting oxidant at a rate between about 5000 standard cubic feet per hour and about 150,000 standard cubic feet per hour.

19. A process for forming clinkers in a rotary kiln in accordance with claim 15, wherein said step of heating said material with a secondary flame comprises injecting secondary oxidant at a rate between about 5000 standard cubic feet per hour and about 150,000 standard cubic feet per hour.

20. A process for forming clinkers in a rotary kiln in accordance with claim 19, wherein said step of heating said material with a secondary flame comprises injecting said secondary oxidant with stoichiometric rates of secondary fuel.

21. A process for forming clinkers in a rotary kiln in accordance with claim 15, wherein said step of injecting primary oxidant comprises injecting an oxidant comprising at least about 21% oxygen into said main burner flame.

22. A process for forming clinkers in a rotary kiln in accordance with claim 21, wherein said step of injecting primary oxidant comprises injecting an oxidant comprising at least about 90% oxygen into said main burner flame.

23. A process for forming clinkers in a rotary kiln in accordance with claim 22, wherein said step of injecting primary oxidant comprises injecting an oxidant comprising at least about 99% oxygen into said main burner flame.

* * * * *

UNITED STATES PATENT AND TRADEMARK OFFICE

CERTIFICATE OF CORRECTION

PATENT NO. : 6,077,072
DATED : June 20, 2000
INVENTOR(S) : Ovidiu MARIN, Mahendra L. JOSHI, Olivier CHARON and Jacques DUGUE It is certified that error appears in the above-indentified patent and that said Letters Patent is hereby corrected as shown below:

On the title page, item [56], above "OTHER PUBLICATIONS", add

--Foreign Patent Documents

| | | |
|---|---|---|
| 93,488 | 09/67 | France |
| 1,281,636 | 10/68 | Germany-- |

Signed and Sealed this

Third Day of April, 2001

*Attest:*

Nicholas P. Godici

NICHOLAS P. GODICI

*Attesting Officer*

*Acting Director of the United States Patent and Trademark Office*